United States Patent [19]

Garat

[11] Patent Number: 5,058,653

[45] Date of Patent: Oct. 22, 1991

[54] PROCESS FOR LOST FOAM CASTING OF METAL PARTS

[75] Inventor: Michel Garat, Voiron, France

[73] Assignee: Aluminium Pechiney, Paris, France

[21] Appl. No.: 550,499

[22] Filed: Jul. 10, 1990

Related U.S. Application Data

[63] Continuation-in-part of Ser. No. 334,530, Apr. 7, 1989, abandoned, which is a continuation-in-part of Ser. No. 116,213, Nov. 3, 1987, abandoned.

[30] Foreign Application Priority Data

Nov. 17, 1986 [FR] France ..... 86 16415

[51] Int. Cl.[5] ..... B22C 9/02; B22D 18/04

[52] U.S. Cl. ..... 164/34; 164/120

[58] Field of Search ..... 164/34, 35, 36, 120

[56] References Cited

U.S. PATENT DOCUMENTS

| | | | |
|---|---|---|---|
| 1,846,913 | 2/1932 | Shapiro | 164/150 |
| 4,139,045 | 2/1979 | Vitt | 164/34 |

FOREIGN PATENT DOCUMENTS

| | | | |
|---|---|---|---|
| 3603310 | 8/1987 | Fed. Rep. of Germany | 164/120 |
| 64-34571 | 2/1989 | Japan | 164/34 |
| 1079353 | 3/1984 | U.S.S.R. | 164/120 |

*Primary Examiner*—Richard K. Seidel
*Assistant Examiner*—Rex E. Pelto
*Attorney, Agent, or Firm*—Dennison, Meserole, Pollack & Scheiner

[57] ABSTRACT

An improvement in the lost foam casting process in which a foam pattern of a part to be cast is immersed in a dry sand mold and the mold is filled with molten metal in order to burn the pattern. According to the improvement, after filling but before the solidified fraction of metal exceeds 40% by weight, an isostatic gas pressure which increases at a predetermined and substantially constant rate to a predetermined maximum value is applied to the mold and maintained at the maximum value until solidification occurs. The rate of increase of pressure is determined as a function of the granulometry of the sand and depth of immersion of the pattern, to cause due to a temporary lag in pressure transmittal through the sand, a rapid and temporary overpressure of the molten metal relative to the sand at the sand/-metal interface. The overpressure reaches a maximum value of 0.001 to 0.030 MPa at the beginning of the pressure application and declines as the applied pressure further increases. The invention is especially useful in the production of cast aluminum alloy parts having an improved level of compactness and a surface which is free from blowholes and carbon inclusions.

6 Claims, 2 Drawing Sheets

PROCESS FOR LOST FOAM CASTING OF METAL PARTS

This application is a continuation-in-part of U.S. patent application Ser. No. 334,530, filed Apr. 7, 1989 (abandoned), which is a continuation-in-part of U.S. Application Ser. No. 116,213, filed Nov. 3, 1987 (abandoned).

BACKGROUND OF THE INVENTION

The present invention relates to an improvement in the process for lost foam casting of metal parts in particular based on aluminum and alloys thereof.

It is known to those skilled in the art, for example from the teaching of U.S. Pat. No. 3,157,924, to effect casting of metals by using patterns of a foam of organic material such as polystyrene which are immersed in a mold formed by dry sand containing no binding agent. In an industrial context, such patterns are generally covered with a film of refractory material which is intended to improve the quality of the cast parts. In such a process the metal to be cast, which has been previously melted, is brought into contact with the pattern by way of a feed orifice and ducts which pass through the sand, and progressively replaces the pattern by burning it and transforming it primarily into vapors which escape between the grains of sand.

In comparison with the conventional casting procedure in a non-permanent mold, the process involving compacting and agglomeration of refractory materials in powder form eliminates the necessity of rigid molds which are associated with cores in a more or less complicated fashion by way of ducts, and permits easy recovery of the cast parts as well as easy recycling of the casting materials. It is therefore simpler and more economical than the conventional procedure. Moreover, it affords the designers of cast parts a greater degree of freedom as regards the shape of the parts. It is for that reason that that procedure has been found to be an increasingly attractive proposition from the industrial point of view.

However, it is handicapped by a number of disadvantages, two of these arising out of conventional metallurgical mechanisms, namely:

the relatively slow rate of solidification, which favors the formation of gassing pits resulting from hydrogen dissolved in the liquid aluminum alloy; and the relatively slight thermal gradients, which favor the formation of micro-size shrinkage holes.

On the other hand, two other disadvantages arise out of mechanisms which are absolutely specific to the lost foam process, namely:

the formation of flaws due to gasified residues from the foam; and the formation of carbon inclusions associated with oxides, as a result of contact between the liquid aluminum alloy and carbonaceous residues from the foam.

USSR Inventors' Certificate SU 1079353A discusses castings hardened in temporary sand-clay molds, and discloses that hardening the castings under increased pressure prevents porosity and results in high casting density. However, the increased pressure leads to mechanical burn-on due to the differential in pressure between the pressure acting on the surface of the melt and the pressure at the metal/mold interface, a differential which arises due to gas filtering through pores in the mold. In order to reduce burn-on of sand, SU 1079353 discloses that the pressure should be increased incrementally while the casting crystallizes, with the pressure being increased 0.1–0.2 MPa in each step at intervals of 0.2–0.4 seconds, with the pressure being held for a period of 1 to 5 seconds. The successive pressure increases are effected once the pressure in the system is equal to the pressure at the metal/mold interface and the pressure differential equals zero. The number of pressure increase steps is selected in such a way that the pressure differential at each step does not exceed a critical pressure and after increasing the pressure in each step, the pressure is held long enough to allow the pressure in the system to equalize with the pressure at the metal/mold interface.

SUMMARY OF THE INVENTION

The process according to the invention is thus an improvement to the conventional steps in lost foam casting, specifically:

obtaining a pattern of the part to be cast formed by a foam of organic material coated with a film of refractory material;

immersing the pattern in a mold formed by dry sand without binder;

filling the mold with metal in the molten state to burn the pattern;

evacuating the vapors and the liquid residues emitted by the burned pattern; and causing the molten metal to solidify to produce the part.

The improvement to this process comprises applying to the mold after filling and before the solidified fraction of metal exceeds 40% by weight, an isostatic gas pressure which increases at a predetermined and substantially constant rate to a predetermined maximum value and then maintaining the pressure at said maximum value until complete solidification occurs. The rate of increase of pressure is determined, as a function of the granulometry of the sand and depth of immersion of the pattern, to cause due to a temporary lag in transmittal of pressure through the sand, a rapid and temporary overpressure on the molten metal relative to the sand at the sand-metal interface. This overpressure reaches a maximum value of 0.001 to 0.030 MPa at the pressure application and then declines as the applied pressure further increases.

DETAILED DESCRIPTION OF THE INVENTION

Figure 1:
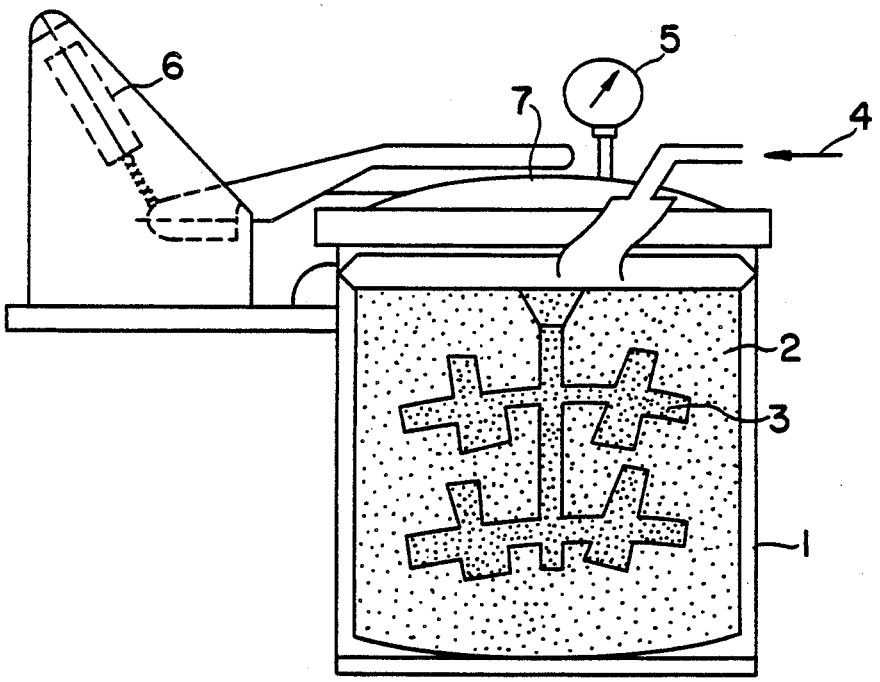
FIG. 1 is a vertical cross-sectional view of an apparatus which can be used to carry out the process of the invention.

In the improvement to the lost foam casting process according to the invention, when the mold has been completely filled, that is to say when the metal has entirely replaced the pattern and the major part of the vapors have been evacuated, a gas pressure is applied to the mold, an operation which can be carried out by placing the mold in a chamber capable of withstanding the pressure, and which is connected to a pressurized gas source.

That operation can be effected immediately after the filling operation when the metal is still entirely liquid but it may also take place at a later time provided that the solidified fraction of metal in the mold does not exceed about 40%, beyond which value the pressure would have a negligible effect.

Preferably the value of the applied pressure must be at a maximum between 0.5 and 1.5 MPa, a value which is lower than 0.5 MPa having an inadequate effect and a value of higher than 1.5 MPa giving rise to high operating costs.

It is then found that the degree of compactness of the parts is considerably increased, eliminating or at least reducing the gas pitting phenomena and micro-size shrinkage holes and thus improving the mechanical characteristics of the parts. However, that does not avoid blowholes and inclusions due to the foam and in addition causes the appearance of a new disadvantage referred to as "interfacial penetration". In fact, when a pressure is applied to a lost foam casting mold without further precautions, the pressure is applied directly to the metal feed orifice where it is transmitted practically instantaneously to the entire mass of liquid metal. The pressure is also applied to the surface of the sand where it is transmitted with a level of intensity which is progressively attenuated due to the lag in transmittal of pressure through the porous mass of grains of sand. That gives rise to a pressure differential $\Delta P$, an overpressure on the metal in relation to the sand at the location of the metal/sand interface, that is to say at the location at which the pattern was in contact with the sand before it was replaced by the molten metal. That differential is temporary, occurs slightly after application of the pressure, and subsequently disappears.

If that pressure differential is excessively great, it causes the metal to penetrate between the grains of sand and gives rise to deformation of the surface of the part. That is what constitutes the phenomenon referred to as "interfacial penetration". In order to remedy that, it is necessary to reduce that pressure differential as much as possible and that is achieved by applying a pressure which progressively rises over time from a value 0 to the maximum desired value, and that maximum pressure is maintained until complete solidification of the metal occurs. In fact, the lower the rate of increase of the pressure at the beginning of application thereof, the lower the level of differential pressure. It is therefore necessary to define a rate of increase in pressure which is sufficiently low to have a reduced level of differential pressure.

The solution to the problem of interfacial penetration, however, does not provide any remedy with regard to the disadvantages such as blowholes and inclusions. Hence, additional research was performed which resulted in the following conclusions. As indicated above, industrial practice of lost foam casting involves coating the patterns with a film of refractory material generally formed by ceramic material particles which are agglomerated by a binder. That film acts as follows: at the moment at which the liquid metal is poured, the foam which is produced in most cases from polystyrene, is eliminated both in gaseous and liquid form. The refractory layer is required to regulate the elimination of the gaseous form by virtue of its permeability and to absorb the liquid form. Generally speaking, the level of permeability must be suited to the part in order to ensure that a cushion of gas between the liquid metal and the foam is maintained and the absorbent capacity is at a maximum to remove the liquid residues. Thus at the end of the mold residues, with the excess having escaped into the sand. That situation therefore involves metal at a temperature of 600° to 800° C., in contact with the layer which is saturated with organic material, which can result in gasification of the liquid which then generates a pressure such that gas penetrates into the metal and forms blowholes therein, while causing the occurrence of carbon inclusions resulting from incomplete combustion of the foam residues.

In order to obviate that disadvantage, it is therefore necessary to create a sufficient overpressure in the liquid metal with respect to the space in the sand behind the film in order to cause discharge of the gaseous and liquid residues towards the sand and thus to prevent them from passing into the metal. That goes against the solution adopted to avoid interfacial penetration, which involved reducing the rate of increase in the pressure as much as possible, in order to reduce the pressure differential.

Finally, the Applicant arrived at a rate which is a compromise between those two requirements, the value of which is between 0.003 and 0.3 MPa per second and decreases in proportion to increasing thickness of the part; values which are outside that range cause one or other of the two disadvantages referred to above to predominate.

That rate must obviously take account of the pressure lag through the mold, that is to say the granulometry of the sand and also the depth of immersion of the pattern in the sand. It is for that reason that the rate is selected in dependence on those parameters and in such a way as to produce overpressure values which are between 0.001 and 0.030 MPa and preferably between 0.002 and 0.010 MPa. That pressure differential is necessary only during a critical period which immediately follows the filling operation, that is to say at the time at which the metal is still liquid at the surface of the part and the film is still saturated with substances which have not totally vaporized. Preferably the maximum overpressure is attained in less than 2 seconds after application of the pressure, at which time the interfacial penetration phenomenon is at its most substantial.

The invention will be better appreciated by reference to the FIG. 1 showing a view in vertical section through an apparatus which can be used to practice the invention.

Shown in FIG. 1 is a sealed enclosure 1 provided with a cover 7 actuated by a jack 6. Within the enclosure is disposed the mold formed by sand 2 which contains no binder. A polystyrene foam pattern 3 is immersed in the mold. A compressed gas is introduced into the enclosure 1 by way of a conduit 4 and the pressure is measured by means of gauge 5.

Figure 2:
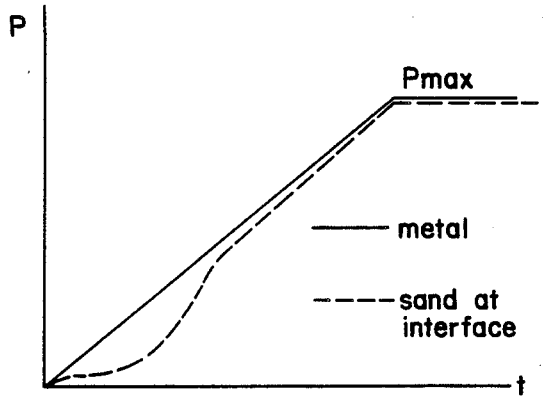
FIG. 2 is a plot of pressure versus time for a casting according to the invention.
Figure 2A:
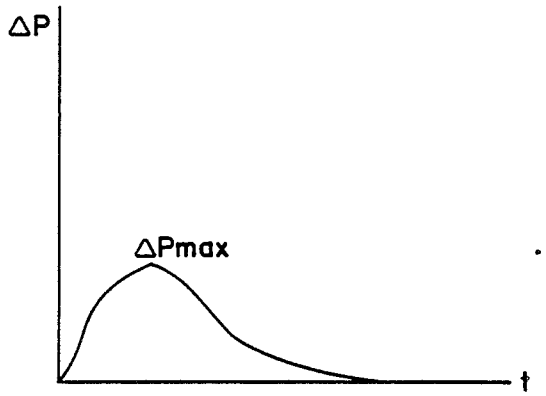
FIG. 2*a* is a plot of pressure differential versus time for this casting.

The pattern of pressurization according to the invention can be seen with reference to FIGS. 2 and 2*a*. In FIG. 2, the pressure on the enclosure, and hence the pressure on the metal increases linearly with respect to time to a predetermined maximum value $P_{max}$. The pressure through the sand at the metal/sand interface lags the pressure on the metal, however, resulting in a pressure differential $\Delta P$ which rises to a maximum value $\Delta P_{max}$ shortly after the pressure is applied to the system.

$\Delta P$ decreases as the pressure on the system is increased and eventually reaches zero.

Figure 3:
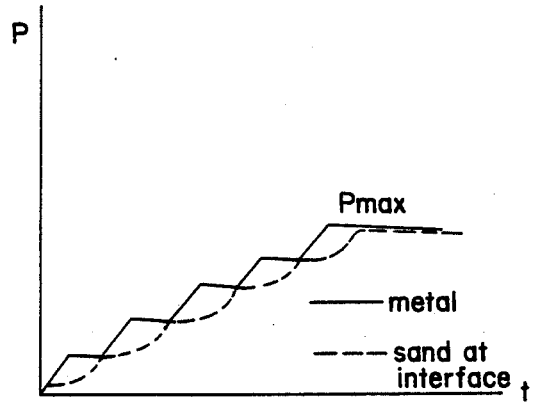
FIG.3 PRIOR ART
FIG. 3 is a plot of pressure versus time for a casting according to SU 1079353.
Figure 3A:
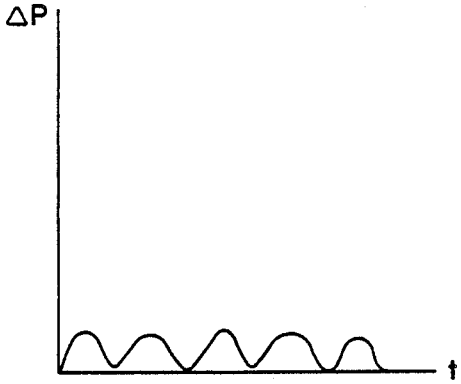
FIG.3a PRIOR ART
FIG. 3*a* is a plot of pressure differential versus time for this casting.

In contrast, FIGS. 3 and 3*a* show the pressurization pattern according to SU 1079353. In this pattern, the pressure on the enclosure, and hence the pressure on the metal increases in a series of steps, with the pressure being held constant after each small increase. While a pressure differential does occur, the period during which the pressure is held constant allows the pressure differential to drop to zero. This pattern of pressurization minimizes $\Delta P$ and accordingly minimizes interfacial penetration, but does not address the problems of blowholes and carbon inclusions as does the method of the invention.

Figure 4:
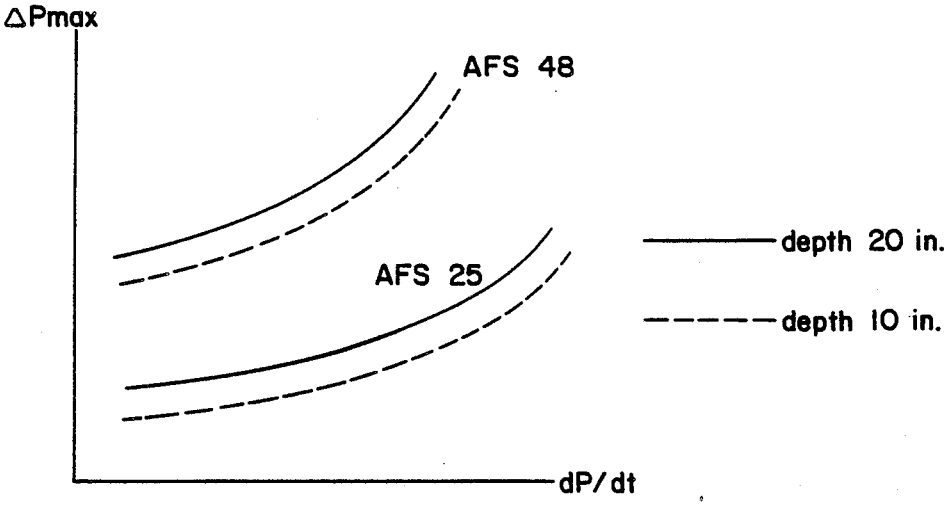
FIG. 4 is a plot of maximum pressure differential versus dP/dt for different sand granulometries and depths of immersion.

As can be seen from FIG. 4, the maximum pressure differential $\Delta P_{max}$ in any particular case will depend upon the rate of increase of pressure, the depth of immersion of the foam in the mold, and the permeability of the sand. Thus, a larger $\Delta P_{max}$ is observed with AFS 48, a less permeable sand, as compared with AFS 25, a more permeable sand. A larger $\Delta P_{max}$ is also associated with a greater depth of immersion of the foam in the mold and a greater rate of increase of pressure.

EXAMPLES 1-2 (comparative)

Two hollow cylindrical bodies of an outside diameter of 45 mm and with a wall thickness of 4 mm, comprising adjacent ribs and bosses measuring 20×20×80 mm, were cast under atmospheric pressure and under an isostatic gas pressure which regularly increases from atmospheric pressure to 1 MPa in 10 seconds applied to the interior of the enclosure containing the mold and just before solidification starts. However, no account was taken in this case of the granulometry of the sand or the depth of immersion of the pattern so that the overpressure was less than 0.001 MPa.

Those bodies were produced from two types of alloys with high mechanical characteristics:

A-S7G03 having a composition in percent by weight: Fe 0.20; Si 6.5-7.5; Cu 0.10; Zn 0.10; Mg 0.25-0.40; Mn 0.10; Ni 0.05; Pb 0.05; Sn 0.05; Ti 0.05-0.20; alloy modified with sodium; remainder Al.

A-U5GT having a composition: Fe 0.35; Si 0.20; Cu 4.20-5.00; Zn 0.10; Mg 0.15-0.35; Mn 0.10; Ni 0.05; Pb 0.05; Sn 0.05; Ti 0.05-0.30; remainder Al.

Mechanical tests were carried out on these bodies after standardized heat treatments Y23 for A-S7G03 and Y24 for A-U5GT made it possible to measure the following characteristics:

in A-S7G03, the quality index Q in MPa which corresponds to the formula $Q=R+150 \log A$ in which R is the ultimate tensile strength and A is the degree of elongation in percent, both in the thick and thin zones of the parts; and in A-U5GT, the yield strength LE in MPa, the ultimate tensile strength R in MPa and the degree of elongation A in percent, also both in thick and thin zones.

The results are set forth in Table 1:

TABLE 1

| | EXAMPLE 1 A-S7G03 | | EXAMPLE 2 A-U5GT | | | | | |
|---|---|---|---|---|---|---|---|---|
| | Thick | Thin | Thick zone | | | Thin zone | | |
| | zone Q | Zone Q | LE | R | A | LE | R | A |
| Solidification under atmospheric pressure | 240 | 325 | 235 | 340 | 8 | 260 | 355 | 7 |
| Solidification under 1 MPa | 335 | 420 | 240 | 365 | 8 | 260 | 405 | 11 |

While it is found that there is an improvement in the mechanical characteristics resulting from an increase in the degree of compactness with solidifying under pressure, the parts had blowholes and carbon inclusions at their surfaces.

EXAMPLES 3-4

The following three examples relate to the casting of an internal combustion engine manifold and cylinder head under conditions which take account of the granulometry of the sand and the depth of immersion of the pattern in order to produce an overpressure on metal at the sand/metal interface according to the invention.

Those conditions are set forth in Table 2:

TABLE 2

| | Example | | |
|---|---|---|---|
| | 3 | 4 | 5 |
| Application of pressure | From the end of the filling operation | From the end of the filling operation | When the degree of solidification reaches 35% |
| Type of part | manifold | cylinder head | cylinder head |
| granulometry of the sand in AFS* | 48 | 48 | 100 |
| Solidification time in seconds | 60 | 240 | 240 |
| Thickness of the part in mm | 4 | 8 | 8 |
| Period of the rise in pressure between 0 and 0.8 MPa in seconds | 12 | 46 | 80 |
| Rate of increase in pressure in MPa/second | 0.066 | 0.017 | 0.01 |
| Maximum $\Delta P$ in MPa | 0.0097 | 0.0046 | 0.0030 |
| Depth of immersion of the pattern in mm | 250 | 450 | 450 |
| Time to attain maximum over-pressure in seconds | 0.9 | 0.6 | 0.4 |

*AFS internationally recognized American Granulometry standards.

The parts which are molded in this manner had very few blowholes and no carbon encrustation, showing the effectiveness of the process according to the invention.

What is claimed is:

1. In a process for lost foam casting of a metal part of different thicknesses comprising the steps of:

obtaining a pattern of the part to be cast formed by a foam of organic material coated with a film of refractory material, immersing said pattern in a mold formed by dry sand without binder, filling the mold with metal in the molten state to burn said pattern, evacuating the vapors and the liquid residues emitted by the burned pattern, and causing the molten metal to solidify to produce said part, the improvement which comprises applying to the mold after filling and before the solidified fraction of metal exceeds 40% by weight, an isostatic gas pressure, increasing said isostatic gas pressure to a predetermined maximum value at a predetermined and substantially constant rate determined, as a function of the granulometry of the sand and depth of immersion of the pattern, to cause due to a temporary lag in pressure transmitted through the sand, a rapid and temporary overpressure on the molten metal relative to the sand at the sand/metal interface, said overpressure reaching a maximum value of 0.001 to 0.030 MPa at the beginning of the pressure application and then declining as the applied pressure further increases, and maintaining said pressure at said maximum value until solidification occurs.

2. A process according to claim 1, wherein the isostatic gas pressure applied attains a maximum value of between 0.5 and 1.5 MPa.

3. A process according to claim 1, wherein the rate of increase in the isostatic gas pressure is between 0.003 and 0.3 MPa/second.

4. A process according to claim 1, wherein the overpressure on the molten metal relative to the sand reaches a maximum value of between 0.002 and 0.010 MPa.

5. A process according to claim 1, wherein the maximum value of the overpressure on the molten metal relative to the sand is attained in less than two seconds.

6. A process according to claim 1, wherein the metal is aluminum or an aluminum alloy.

* * * * *